United States Patent [19]

Hagen

[11] 4,430,983

[45] Feb. 14, 1984

[54] CARBURETOR BLEED AIR CONTROL SOLENOID IMPROVEMENT

[75] Inventor: William A. Hagen, St. Ann, Mo.

[73] Assignee: ACF Industries, Inc., New York, N.Y.

[21] Appl. No.: 420,424

[22] Filed: Sep. 20, 1982

Related U.S. Application Data

[63] Continuation of Ser. No. 218,278, Dec. 19, 1980, abandoned.

[51] Int. Cl.[3] ..... F02M 23/00

[52] U.S. Cl. ..... 123/585; 239/585; 339/154 R

[58] Field of Search ..... 123/585, 589, 440, 472; 239/585; 251/129; 339/153, 154 R, 154 A, 154 L, 191-193

[56] References Cited

U.S. PATENT DOCUMENTS

| | | | |
|---|---|---|---|
| 3,253,248 | 5/1966 | Brown | 339/99 |
| 3,519,977 | 7/1970 | Swearingen | 339/36 |
| 3,602,748 | 8/1971 | Locke | 339/31 |
| 3,644,938 | 2/1972 | Slate | 339/91 |
| 3,717,179 | 2/1973 | Clark | 137/625.25 |
| 3,839,943 | 10/1974 | Ufnalewski | 123/472 |
| 4,023,357 | 5/1977 | Masaki | 123/589 |
| 4,114,372 | 9/1978 | Ikeura | 123/589 |
| 4,197,996 | 4/1980 | Giardini | 239/87 |
| 4,230,273 | 10/1980 | Claxton et al. | 239/125 |
| 4,235,375 | 11/1980 | Melotti | 239/585 |
| 4,274,700 | 6/1981 | Keglewitsch et al. | 339/192 R |
| 4,284,312 | 8/1981 | Patchett et al. | 339/60 R |

*Primary Examiner*—Charles J. Myhre
*Assistant Examiner*—E. Rollins Cross
*Attorney, Agent, or Firm*—J. Joseph Muller

[57] ABSTRACT

An end closure (1) for a pulsing solenoid P attached to a carburetor (C). A unitary cover (3) has a base section (5) configured to fit against an end wall (EW) of a solenoid housing (H). A forwardly extending skirt section (9) fits about the side wall (SW) of the housing adjacent the end wall thereof. The skirt section has a plurality of tabs (11) projecting from the inner wall of the skirt section. The tabs are received in appropriate openings (0) in the side wall of the housing. A connector shield (13) projects rearwardly from the base section of the cover. A pair of electrical connectors (15A, 15B) are mounted in the shield and extend through the base section of the cover. The electrical connectors matingly connect with a pair of electrical connectors (FC) in the solenoid housing and further connect with an electrical cable routed from an electronic control unit. An electrical signal from the control unit is supplied to the solenoid through the cable and the electrical connectors in the shield to operate the solenoid.

12 Claims, 6 Drawing Figures

CARBURETOR BLEED AIR CONTROL SOLENOID IMPROVEMENT

This is a continuation of application Ser. No. 218,278, filed Dec. 19, 1980 now abandoned.

BACKGROUND OF THE INVENTION

This invention relates to carburetor control devices and, more particularly, to an improvement for a pulsed solenoid used to control air bleeds to a carburetor's fuel circuits.

For some time, solenoids have been used with carburetors to control the bleeding of air into carburetor fuel circuits. Typically, an electronic control unit responds to electrical signals from various transducers to generate a control signal supplied to the solenoid. The armature of the solenoid is moved in response to this signal or variations in the signal to open or close air paths by which air is admitted into the carburetor fuel circuits. The net result is better control over the air-fuel ratio of the mixture produced by the carburetor, this helping increase fuel economy and reduce engine emissions.

Assembly of the solenoids used in the above-described control systems has previously required soldering of the input lines from the control unit to the coil winding leads of the solenoid. This is a time consuming assembly step. Further, because the solenoid is mounted on a bracket adjacent the carburetor, it is subjected to the same shock and vibrations the carburetor experiences. Over time, this can cause the connection to fail rendering the solenoid useless for control purposes.

SUMMARY OF THE INVENTION

Among the several objects of the present invention may be noted the provison of an improvement in a solenoid used to control air bleeds to the fuel circuits of a carburetor; the provision of such an inprovement which reduces assembly time of the solenoid during manufacture thereby reducing costs; the provision of such an improvement which simplifies installation of the solenoid on the carburetor assembly; and the provision of such an improvement which produces an electrical connection between the solenoid and an electronic controller that is less susceptible to failure due to engine shock and vibration.

Briefly, the improvement of the present invention comprises an end closure for a pulsing solenoid attached to a carburetor for an internal combustion engine and includes a unitary cover having a base section configured to fit against an end wall of the solenoid housing. A forwardly extending skirt section fits about the side wall of the housing adjacent the e-d wall thereof. The skirt section has a plurality of tabs projecting from the inner wall of the skirt section, the tabs being received in appropriate openings in the side wall of the housing. A connector shield projects rearwardly from the base section of the cover. A pair of electrical connectors are mounted in the shield and extend through the base section of the cover. The electrical connectors matingly connect with a pair of electrical connectors in the solenoid housing and with an electrical cable routed from an electronic control unit. An electrical signal from the control unit is supplied to the solenoid through the cable and the electrical connectors in the shield to operate the solenoid. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
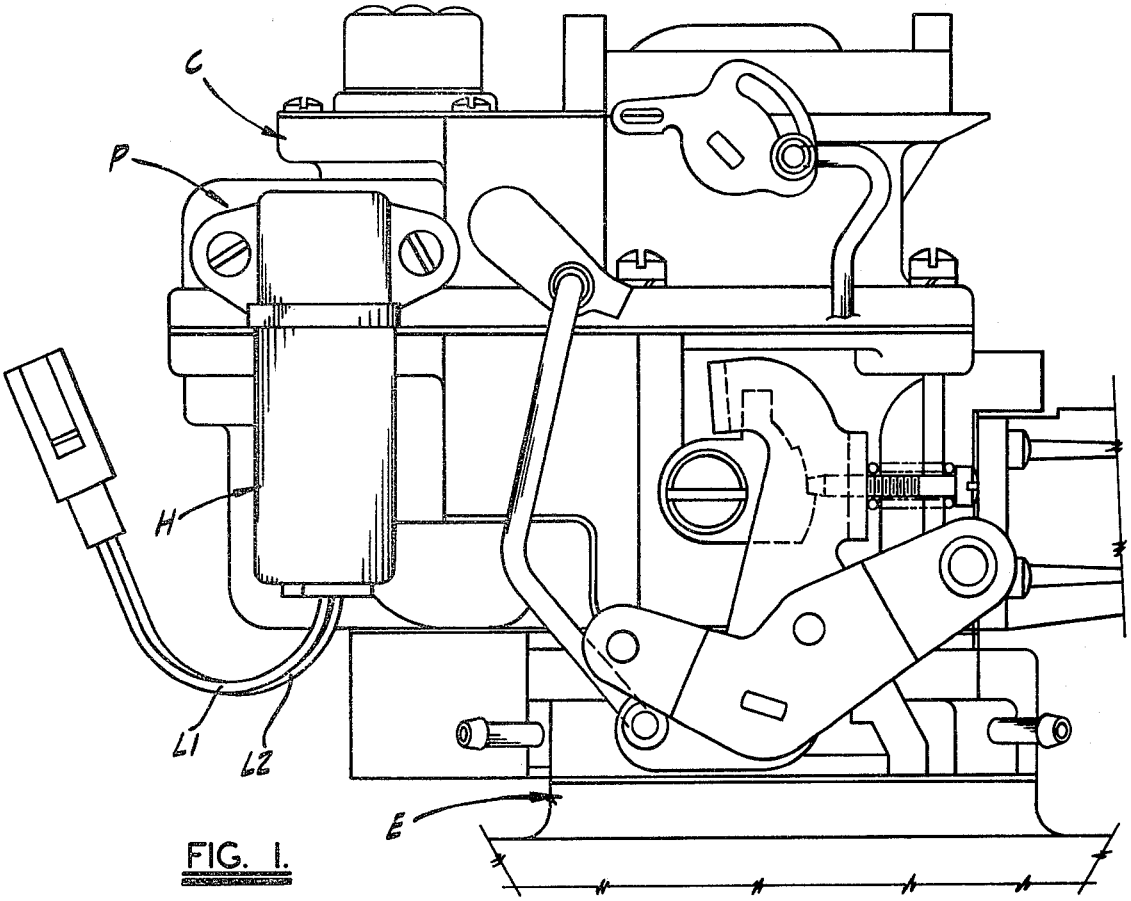
FIG. 1 is a side elevational view of a carburetor with a pulsing solenoid attached thereto.

Referring to the drawings, a pulsing solenoid P is attached to a carburetor C for an internal combustion engine E. The solenoid controls the bleeding of air to carburetor fuel circuits (not shown). The construction and operation of a pulsing solenoid P to control bleed air is described in U.S. patent application Ser. No. 108,483, filed Dec. 31, 1979, and assigned to the same assignee as the present application. The elements constituting pulsing solenoid P are generally contained in a solenoid housing H with electrical lines L1 and L2 being routed to the solenoid from an electronic control unit (not shown). A control signal developed by the control unit is supplied to the pulsing solenoid to control its operation via these lines. Conventionally, the ends of the lines L1 and L2 are soldered to appropriate terminals within housing H. The soldering operation is a time consuming manufacturing step and over time, the solder connections may fail due to engine shock and vibration. Such a failure renders the pulsing solenoid inoperative which ultimately affects engine fuel economy and exhaust emissions.

The improvement of the present invention comprises an end closure 1 for the pulsing solenoid and includes a unitary or integral cover 3 having a base section 5 configured to fit against or abut an end wall EW of housing H. Thus, for a generally cylindrical solenoid housing H, base section 3 is circular in plan and has a diameter equal to the outer diameter (o.d.) of the housing. Further, the base section may have a raised portion 7 to accomodate any end wall projections such as the projection EWP shown in FIG. 3.

Figure 2:
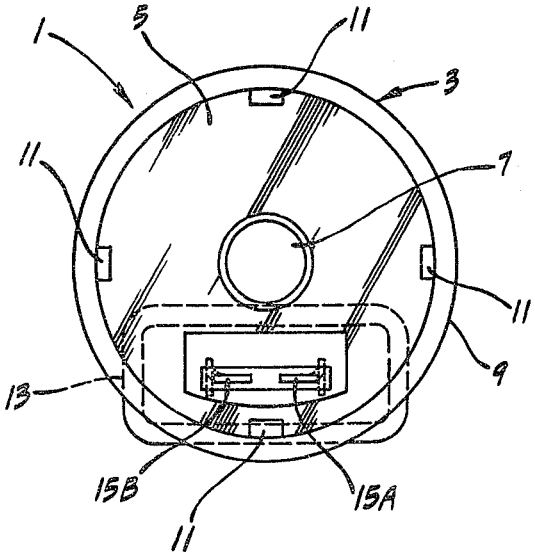
FIG. 2 is a front elevational view of a first embodiment of the improvement of the present invention.
Figure 3:
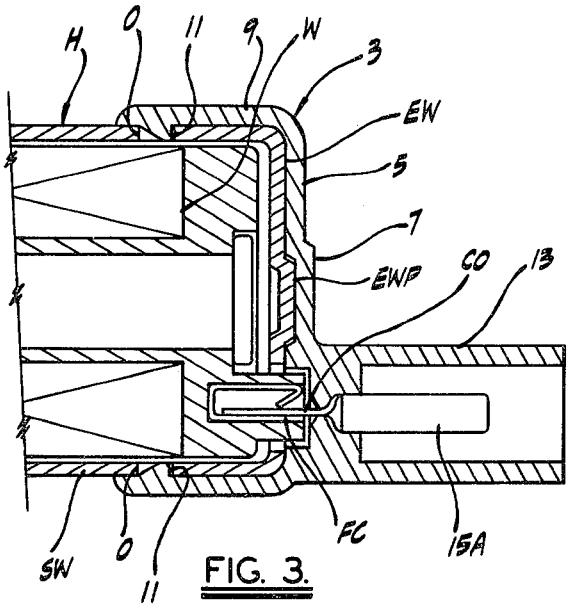
FIG. 3 is a partial side elevational view, in section, of the embodiment shown in FIG. 2.

End closure 1 further includes a forwardly extending skirt section 9 which fits about the side wall SW of housing H. Skirt section 9 is cylindrical in shape and the inner diameter (i.d.) of the skirt section is equal to the outer diameter (o.d.) of side wall SW. The side wall has a plurality of spaced apart openings O formed therein, two such openings being shown in FIG. 3. A plurality of tabs 11 project outwardly from the inner wall of skirt section 9, four tabs 11 being shown in FIG. 2. The tabs fit into the openings in the side wall of the housing to secure end closure 1 to the housing. As shown in FIG. 3, the front face of each tab 11 is inclined from front to back to facilitate installation of end closure 1 over the end of housing H.

End closure 1 further has a connector shield 13 projecting rearwardly from base section 5 of cover 3. A pair of electrical connectors, 15A and 15B respectively, are mounted in shield 13 and extend through base section 3 of the cover. Each end of each electrical connector has a male terminal with the terminal at one end of each connector being oriented or turned 90° with respect to the male terminal at the other end of the connector. In addition, the male terminals at each end of each electrical connector are "spade" connectors.

As shown in FIG. 3, a female electrical connector FC is located at the rear of solenoid housing H and end wall EW of the housing has connector openings CO therein for accessing the female connectors. The female electrical connectors FC are located in housing H and are connected to respective ends of the electrical wiring comprising a solenoid winding W. When end closure 1 is installed over the back end of solenoid housing H, the male terminals of connectors 15A and 15B projecting forwardly through base section 5 of cover 3 matingly connect with an appropriate female electrical connector FC as shown in FIG. 3.

Figure 4:
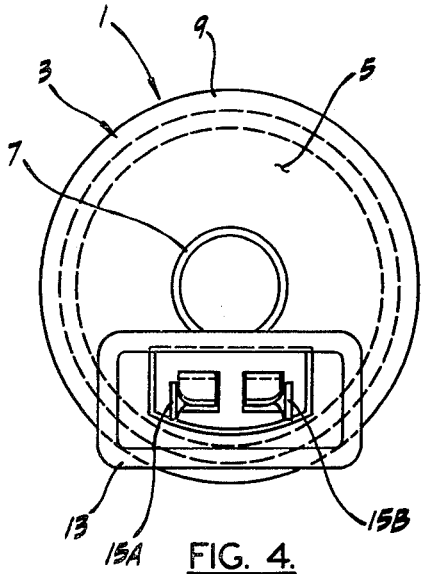
FIG. 4 is a rear elevational view of the embodiment shown in FIGS. 2 and 3.

Connector shield 13 is rectangular in shape as shown in FIG. 4 to accomodate a rectangular plug (not shown) for an electrical cable routed to pulsing solenoid P from an electronics control unit. The plug end of such a cable has two female electrical connectors similar to the connectors FC, but oriented so the rear male terminals of each connector 15A and 15B matingly connect with the female connectors in the cable plug. When this latter set of connections is made, an electrical signal from the control unit is supplied to pulsing solenoid P through the cable and the elctrical connectors to operate the solenoid. While the connector shield shown in FIG. 4 is rectangular in shape, the length and shape of connector shield 13 may be such as to accomodate any particular cable plug configuration.

Figure 5:
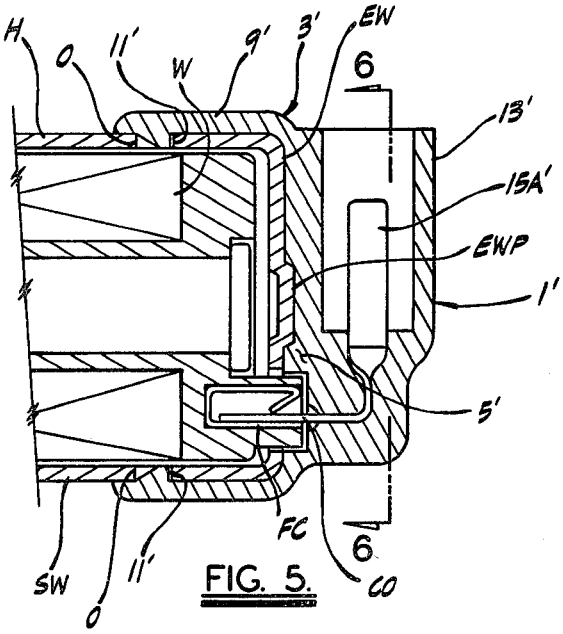
FIG. 5 is a partial side elevational view, in section, of a second embodiment of the improvement of the present invention, and, FIG. 6 is a view of the embodiment shown in FIG. 5 taken along line 6—6 of FIG. 5.
Figure 6:
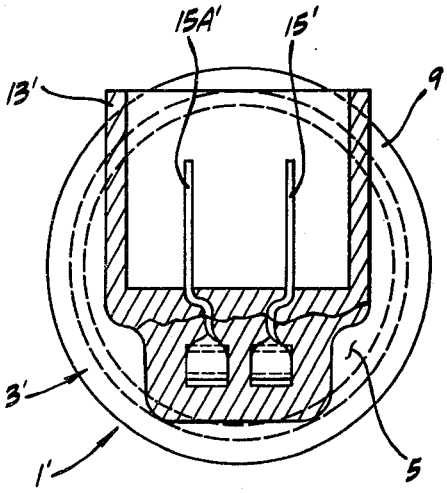

Referring to FIGS. 5 and 6, a second embodiment of the improvement of the present invention is an end closure 1' comprising a unitary cover 3' having a base section 5' and a forwardly extending skirt section 9' with a plurality of tabs 11' projecting from the inner wall of the skirt section and received in appropriate openings O in the sidewall SW of housing H. Cover 3' also has a connector shield 13' which, unlike the connector shield shown in FIG. 3, is L-shaped with the outer end of the shield opening upwardly instead of rearwardly. A pair of electrical connectors 15A' and 15B' (see FIG. 6) are mounted in shield 13' and extend through base section 3' of the cover. Connectors 15A' and 15B' are also L-shaped with each end of each connector having a male terminal. The forward terminals of connectors 15A' and 15B' matingly connect with the female electrical connector FC located in solenoid housing H as before. Now, however, the plug end of the electrical cable from the electronic control unit is inserted in connector shield 13' from above, rather than from behind. The upwardly extending male terminals of connectors 15A' and 15B' again matingly connect with appropriate female connectors in the plug end of the cable. Further, the length and shape of connector shield 15' may be such to accomodate an appropriately shaped cable plug. The L-shape of connector shield 13' permits the plug end of a cable to be conveniently mated with the electrical connector if the cable cannot be routed to the rear end of the solenoid, but routed from above.

The advantages of an end closure such as end closures 1 or 1' is the elimination of solder connections between the cable or lines from an electronic control unit and a pulsing solenoid P which simplifies manufacturing, reduces the possibility of connection failure due to shock and vibration, and also facilitates installation and removal of the pulsing solenoid from the carburetor.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. In a pulsing solenoid attached to a carburetor for an internal combustion engine, the solenoid controlling bleed air to a carburetor fuel circuit and the solenoid having a housing in which the elements comprising the solenoid are contained, the improvement comprising an end closure for the solenoid including a unitary cover having a base section configured to fit against an end wall of the housing; a forwardly extending skirt section fitting about the side wall of the housing adjacent the end wall thereof, the skirt section having a plurality of tabs projecting from the inner wall of the skirt section, the tabs being received in appropriate openings in the side wall of the housing; a connector shield projecting rearwardly from the base section of the cover; and, a pair of electrical connectors mounted in the shield and extending through the base section of the cover, the electrical connectors matingly connecting with a pair of electrical connectors in the solenoid housing, the electrical connectors mounted in the shield further connecting with an electrical cable routed from an electronic control unit whereby an elecfrical signal from the control unit is supplied to the solenoid through the cable and the electrical connectors in the shield to operate the solenoid.

2. The improvement as set forth in claim 1 wherein the length and shape of the connector shield is such that the end of the cable fits into the shield to mate the electrical connectors with the cable.

3. The improvement as set forth in claim 1 wherein both ends of each electrical connector in the cover have male terminals, the male terminal at one end of each connector being oriented 90° from the male terminal at the other end of the connector.

4. The improvement as set forth in claim 3 wherein the male terminals at each end of each electrical connector are spade terminals.

5. The improvement as set forth in claim 1 wherein the connector shield is L-shaped to permit the end of the cable to be mated with the electrical connectors at a convenient angle.

6. The improvement as set forth in claim 5 wherein both electrical connectors are L-shaped with male terminals at each end.

7. An end closure for a pulsing solenoid, the solenoid being attached to a carburetor for an internal combustion engine and used to control bleed air to a fuel circuit of the carburetor, and the solenoid having a housing in which the elements comprising the solenoid are contained; the end closure comprising a unitary cover having a base section configured to fit against an end wall of the housing; a forwardly extending skirt section fitting about the side wall of the housing adjacent the end wall, the skirt section having a plurality of tabs projecting from the inner wall of the skirt section, the tabs being received in appropriate openings in the side wall of the housing; a connector shield projecting rearwardly from the base section of the cover; and, a pair of electrical connectors mounted in the shield and extending through the base section of the cover, the electrical connectors matingly connecting with a pair of electrical connectors in the solenoid housing, the electrical connectors mounted in the shield further connecting with an electrical cable routed from an electronic control unit whereby an electrical signal from the control unit is supplied to the solenoid through the cable and electrical connectors in the shield to operate the solenoid.

8. An end closure as set forth in claim 7 wherein both ends of each electrical connector in the cover have male terminals, the male terminal at one end of each connector being oriented 90° from the male terminal at the other end of the connector.

9. An end closure as set forth in claim 8 wherein the connector shield is L-shaped along its length to permit the end of the cable to be mated with the electrical connectors at a convenient angle.

10. An end closure for a pulsing solenoid comprising a unitary cover having a base section configured to fit against an end wall of a solenoid housing; a forwardly extending skirt section fitting about a side wall of the housing adjacent the end wall, the skirt section having a plurality of tabs projecting from the inner wall of the skirt section, the tabs being received in appropriate openings in the side wall of the housing; an L-shaped connector shield projecting rearwardly from the base section of the cover; a pair of L-shaped electrical connectors mounted in the shield and extending through the base section of the cover, each electrical connector being a male-male spade type connector for matingly connecting with a pair of electrical connectors in the solenoid housing, the electrical connectors mounted in the shield further connecting with an electrical cable routed to the pulsing solenoid whereby an electrical signal is supplied to the solenoid through the cable to operate the soleniod.

11. In a solenoid for attachment to a carburetor for an internal combustion engine, the solenoid controlling bleed air to a carburetor fuel circuit and the solenoid having a housing in which the elements comprising the solenoid are contained; the improvement comprising an end closure for the solenoid including a cover having a base section configured to fit against an end wall of the housing, and a skirt section extending forwardly from the base section fitting about the side wall of the housing adjacent the end wall thereof; coacting fastener means on said skirt section and said side wall of said housing to connect the cover to the housing upon positioning of the cover over the housing at a predetermined location; a connector shield projecting rearwardly from the base section of the cover; and, a pair of electrical connectors mounted in the shield and extending through the base section of the cover, the shield electrical connectors electrically connecting with a pair of electrical connectors in the solenoid housing, the electrical connectors in the shield being mounted for connection to an electrical cable routed from an electronic control unit whereby an electrical signal from the control unit is supplied to the solenoid through the cable and the electrical connectors in the shield to operate the solenoid.

12. In a solenoid for attachment to a carburetor for an internal combustion engine to control bleed air to a carburetor fuel circuit, the solenoid having a housing in which the elements comprising the solenoid are contained and said housing having a pair of electrical connectors with female terminals accessible from an end wall thereof; the improvement comprising an end closure for the solenoid including a cover having a base section configured to fit against said end wall of the housing, and a skirt section extending forwardly from the base section fitting about the side wall of the housing adjacent the end wall thereof; coacting fastener means on said skirt section and said side wall of said housing to connect the cover to the housing upon positioning of the cover over the housing at a predetermined location; a connector shield integrally connected to and projecting rearwardly from the base section of the cover; and, a pair of electrical connectors mounted in the shield having a first pair of male terminals on one end extending through and projecting forwardly from the base section of the cover, said first pair of male terminals interfitting with said, female terminals in said solenoid housing, said shield electrical connectors having a second pair of male terminals on the other end thereof mounted for connection to an electrical cable routed from an electronic control unit whereby an electrical signal from the control unit is supplied to the solenoid through the cable and the electrical connectors in the shield to operate the solenoid.

* * * * *